US006113011A

United States Patent [19]

Potz et al.

[11] Patent Number: 6,113,011

[45] Date of Patent: Sep. 5, 2000

[54] FUEL INJECTION VALVE FOR INTERNAL COMBUSTION ENGINES

[75] Inventors: Detlev Potz, Stuttgart; Stephan Haas, Mammendorf; Thomas Kuegler, Korntal-Muenchingen, all of Germany

[73] Assignee: Robert Bosch GmbH, Stuttgart, Germany

[21] Appl. No.: 09/355,501

[22] PCT Filed: Jun. 26, 1998

[86] PCT No.: PCT/DE98/01760

§ 371 Date: Jul. 29, 1999

§ 102(e) Date: Jul. 29, 1999

[87] PCT Pub. No.: WO99/28619

PCT Pub. Date: Jun. 10, 1999

[30] Foreign Application Priority Data

Nov. 29, 1997 [DE] Germany ..... 197 53 162

[51] Int. Cl.[7] ..... F02M 59/00

[52] U.S. Cl. ..... 239/533.2; 239/533.7; 239/533.12; 239/541; 239/453; 251/284

[58] Field of Search ..... 239/533.1, 533.2, 239/533.3, 533.7, 533.9, 533.12, 533.15, 583, 584; 251/60, 284

[56] References Cited

U.S. PATENT DOCUMENTS

| | | | |
|---|---|---|---|
| 5,405,088 | 4/1995 | Gordon et al. | 239/453 |
| 5,497,947 | 3/1996 | Potz et al. | 239/533.12 |
| 5,518,184 | 5/1996 | Potz et al. | 239/533.9 |
| 5,522,550 | 6/1996 | Potz et al. | 239/533.9 |
| 5,743,470 | 4/1998 | Schlaf et al. | 239/533.9 |
| 5,755,385 | 5/1998 | Potz et al. | 239/533.2 |

FOREIGN PATENT DOCUMENTS

| | | |
|---|---|---|
| 826878 | 4/1998 | European Pat. Off. . |
| 750183 | 12/1944 | Germany . |
| 19543994 | 5/1997 | Germany . |
| 4310154 | 4/1998 | Germany . |

*Primary Examiner*—Andres Kashnikow
*Assistant Examiner*—Lisa Ann Douglas
*Attorney, Agent, or Firm*—Ronald E. Greigg; Edwin E. Greigg

[57] ABSTRACT

A fuel injection valve for internal combustion engines, having a valve member, which is guided axially displaceably in a bore of a valve body. An end toward the combustion chamber and that protrudes from the bore has a valve sealing face with which the valve member cooperates, to control an injection cross section, with a valve seat face on the valve body. A stroke stop face which is stationary relative to the valve body and with which the valve member comes into contact with a bearing face after traversing an outward-oriented maximum opening stroke distance, and the stroke stop face is disposed on an end face of an axially split stroke stop ring which is surrounded by a support ring. A valve spring urges the valve member in the closing direction and is supported stationary on the valve body via a spacer ring and an intermediate member. The support ring surrounding the stroke stop ring is supported stationary relative to the valve body and constantly contacts the spacer ring.

16 Claims, 2 Drawing Sheets

FUEL INJECTION VALVE FOR INTERNAL COMBUSTION ENGINES

PRIOR ART

The invention is based on a fuel injection valve for internal combustion engines. One such fuel injection valve, known from German Patent Application 1 96 34 716.5, not published prior to the filing date of the present application, has a valve body with an axial through bore in which a pistonlike valve member is guided; to control an injection cross section this valve member is displaceable outward by the high fuel pressure, counter to the force of a valve spring. On its end toward the combustion chamber, the valve member has a closing head that protrudes from the bore of the valve body; the closing head forms a valve closing member, and a valve sealing face is disposed on its side toward the valve body; with the valve sealing face, the closing head cooperates with a valve seat face disposed on the face end of the valve body toward the combustion chamber. In addition, at least one injection port, originating in a pressure chamber formed between the valve member and the bore, is provided on the valve member at the level of the closing head. The outlet opening of the injection port is covered by the valve body in the closing position of the valve member, and it is not opened, in the course of the outward-oriented opening stroke of the valve member, until the valve member emerges from the bore. With its end remote from the combustion chamber and from the closing head, the valve member protrudes into a spring chamber, which is formed in a holding body that is axially braced with the valve body. On its shaft end remote from the combustion chamber, the valve member has a spring plate, and a closing spring is housed between the spring plate and a stop contacting the valve body and structurally connected to the housing.

The maximum opening stroke motion of the valve member is defined by the contact of a bearing face, formed by a collar on the valve member shaft, with a stationary stroke stop ring, and the maximum opening stroke can be adjusted by way of the stroke stop ring.

The known fuel injection valve has the disadvantage, however, that the entire bracing force of the valve spring is transmitted to the valve body only via the stroke stop ring. Because of the small bearing face area of the stroke stop ring, this leads to so-called hammering into the valve body, and as a consequence the opening stroke of the valve member may change. The adjustment of different opening stroke courses is also done by means of stroke stop rings of various sizes, and as a result in each case the spring prestressing force of the valve spring also changes, so that the opening characteristic of the fuel injection valve changes again as well.

ADVANTAGES OF THE INVENTION

The fuel injection valve according to the invention for internal combustion engines has an advantage over the prior art that the bracing force of the valve spring is initiated via the spacer ring onto the support ring surrounding the split stroke stop ring. This support ring is supported stationary relative to the valve body, and it can be braced directly with its annular end face, or via the fastening of the stroke stop ring end place, on the valve body. In this way, a large bearing face is achieved for introducing force into the valve body, which reliably prevents the components from being hammered into the end face of the valve body. Furthermore, the use of stroke stop rings of various heights to establish the maximum valve member opening stroke motion now no longer affects the spring prestressing force of the valve spring, since the valve spring is braced on the valve body via the support ring, and the stroke stop ring preferably has some play relative to the spacer ring. The stroke stop ring is preferably embodied in two parts but can alternatively also be subdivided into more partial segments. The preferably two half shells of the axially split stroke stop ring, in the mounted state of the fuel injection valve, then form a completely closed stroke stop ring, which on its face end toward the spacer ring has a conical stroke stop face and rests with its opposite annular end face on the valve body. Both the stroke stop face on the stroke stop ring and the bearing face cooperating with it on the valve member are embodied conically.

The preferably two half shells of the axially split stroke stop ring are preferably made by intentional breakage (cracking). To that end, at least in the region of the rated breaking points, the stroke stop ring is made from a brittle material, so that the half shells can be broken without deformation; this has the advantage that subsequently, in the assembly of the fuel injection valve, they can be put back together again without any gaps. In this way, the bearing face of the stroke stop face is enlarged, and non-round areas on the stroke stop ring are avoided, which further improves the introduction of force into the stroke stop ring and on into the support ring surrounding it. The stroke stop ring is advantageously made by a non-metal cutting method, preferably pressing, forging, or sintering.

In a preferred exemplary embodiment, the spacer ring and the support ring that surrounds the split stroke stop ring are embodied as a one-piece component, preferably a sleeve. This sleeve is guided by its outer circumference in a receiving bore in a valve holding body braced axially with the valve body. The internal diameter of this sleeve is embodied as a stepped bore, and the smaller bore diameter forms the original spacer ring, while the larger bore diameter forms the original support ring. The sleeve can rest axially on a plane end face region of the stroke stop ring, and it is especially advantageous to provide a conical annular collar on the stroke stop ring, against the collar the sleeve is braced with a conical end face. The cone angle at this contact face is advantageously embodied such that the fastening force of the valve spring at the sleeve is oriented radially inward toward the stroke stop ring, so that the force holding the two half shells of the stroke stop ring together is reinforced by an inward-acting radial force. The bracing of the combined support and spacer sleeve via the stroke stop ring has the further advantage that the spring force is now introduced to the valve body via a large annular end face, and this large annular end face is now formed, according to the invention, from the sum of the annular end faces of the original support ring and stroke stop ring.

The fuel injection valve of the invention is embodied as an outward-opening injection valve; it is especially advantageous to use the stroke stop components described in a so-called variable-register nozzle with injection port cross sections disposed one above the other.

Further advantages and advantageous features of the subject of the invention will become apparent from the description, drawing and claims.

BRIEF DESCRIPTION OF THE DRAWINGS

Four exemplary embodiments of the fuel injection valve according to the invention for internal combustion engines are shown in the drawings and will be described in further detail in the ensuing description.

DESCRIPTION OF THE EXEMPLARY EMBODIMENTS

Figure 1:
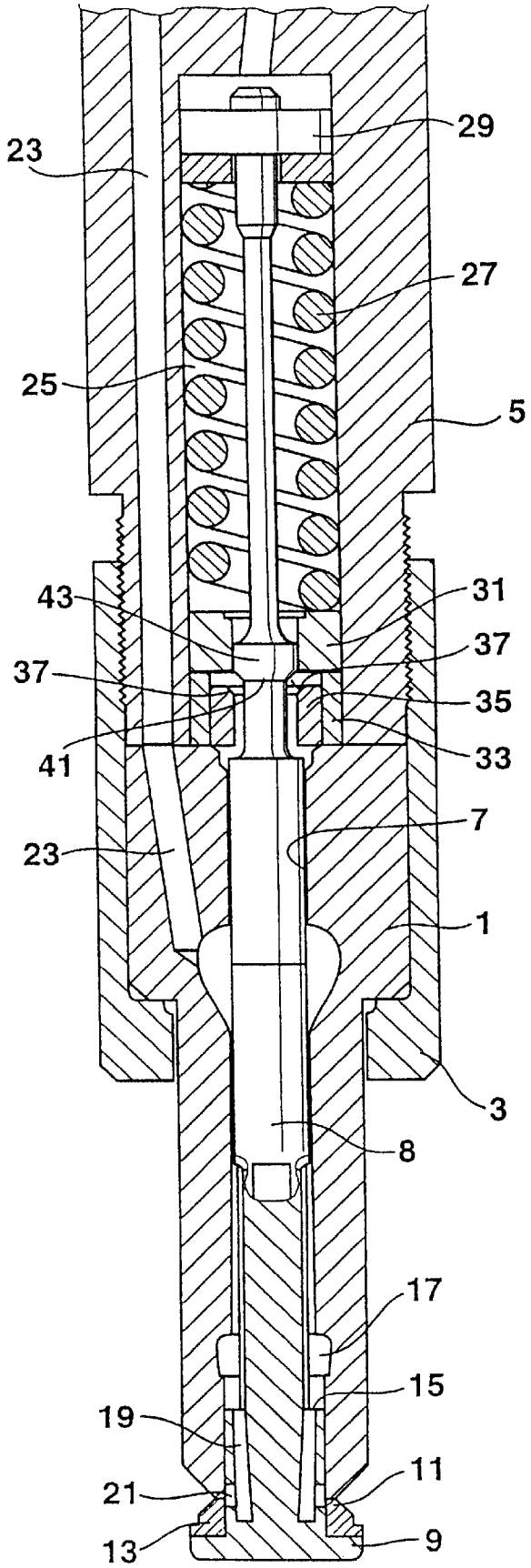
FIG. 1 shows the fuel injection valve of the invention in a longitudinal section.

The fuel injection valve according to the invention for internal combustion engines, shown in FIG. 1, has a valve body 1 which is braced axially against a valve holding body 5 by means of a union nut 3. The valve body 1, protruding with its free end into the combustion chamber of the engine, has an axial guide bore 7, in which a pistonlike valve member 8 is axially displaceably guided; a valve closing head 9 is disposed on the end of the valve member, toward the combustion chamber, that protrudes from the guide bore 7. This valve closing head 9 has a conical valve sealing face 11, oriented toward the valve body 1, which cooperates with a corresponding conical valve seat face 13 on the face end of the valve body 1 toward the combustion chamber. The portion of the valve closing head 9 protruding into the guide bore 7 and radially offset from the part having the sealing face 11 is embodied as a piston slide, which with its annular end face 15 remote from the combustion chamber defines a pressure chamber 17 inside the guide bore 7; a plurality of axial inlet conduits 19 in the valve closing head 9 originate in this pressure chamber, and one radial injection port 21 leads away from each of these conduits. The outlet openings of the injection ports 21 are disposed in such a way that when the injection valve is closed, with the valve member 8 resting on the valve seat 13, are closed by the wall of the guide bore 7 and do not emerge from coincidence with the valve body 1 until in the course of the outward-oriented opening stroke of the valve member 8.

The delivery of high-pressure fuel to the pressure chamber 17 is effected via a high-pressure conduit 23, which axially penetrates the valve body 1 and the valve holding body 5 and to which an injection line leading away from a fuel injection pump, not shown, is connected.

With its valve member shaft remote from the combustion chamber, the valve member 8 protrudes into a spring chamber 25 provided in the valve holding body 5, into which chamber a valve spring 27 urging the valve member 8 in the closing direction toward the valve seat 13 is inserted. A spring plate 29 is disposed on the end remote from the combustion chamber of the valve member 8, and between the spring plate and a spacer ring 31 structurally connected to the housing, the valve spring 27 is fastened.

Figure 2:
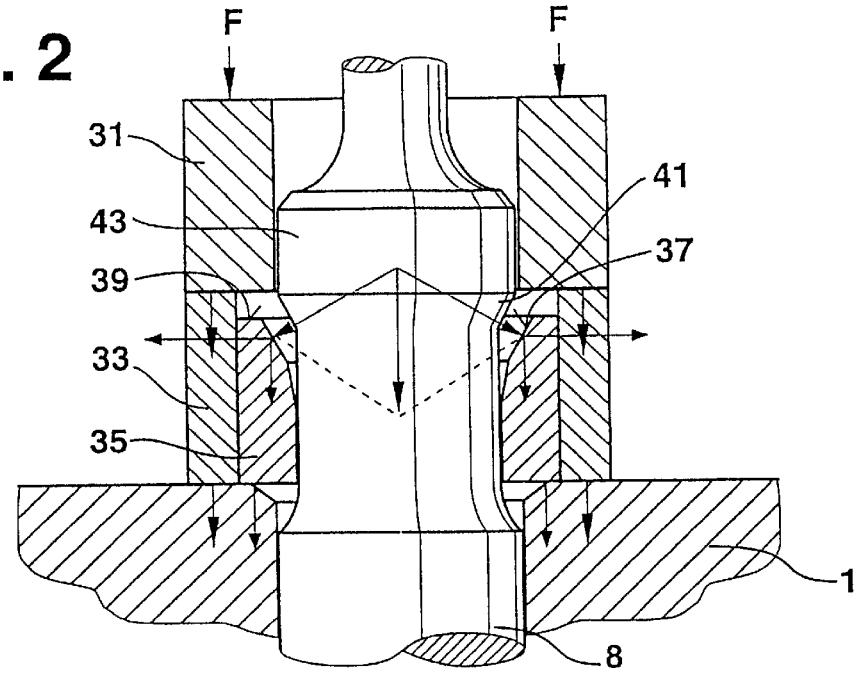
FIG. 2 shows a first exemplary embodiment in an enlarged detail of FIG. 1, in which the spacer ring and the support ring are embodied as two separate components.

The spacer ring 31 shown in FIG. 2, in an enlarged detail from the first exemplary embodiment in FIG. 1, rests with its annular end face, remote from the valve spring 27, on a support ring 33, which is braced by its annular end face, remote from the spacer ring 31, on the end face of the valve body 1 remote from the combustion chamber. A stroke stop ring 35 is inserted radially inside this support ring 33 and rests with its lower annular end face on the valve body 1, while on its end remote from the combustion chamber it has a conical stroke stop face 37. This conical stroke stop face is formed at the cross-sectional transition between a plane and face region 39 and the through bore in the stroke stop ring 35. Cooperating with this stroke stop ring 35 in order to limit the outward-oriented valve member opening stroke motion is a bearing face 41 on the valve member 8; this bearing face is formed on a shoulder, toward the combustion chamber, of an annular collar 43 on the valve member shaft 8 and has a spacing from the stroke stop face 37, when the injection valve is closed, that defines the maximum opening stroke course. This bearing face 41 is embodied conically, like the stroke stop face 37; the two conical contact faces have the same cone angle, in order to furnish the largest possible bearing and force introduction surface area.

For mounting on the cross-sectional constriction of the valve member 8, the stroke stop ring 35 is formed of two half shells, which are produced by splitting a stroke stop ring 35 that has otherwise been machined to its final form, as will be described hereinafter.

The half shells of the stroke stop ring 35 are inserted into the support ring 33, so that the spreading forces introduced to the half shells are absorbed by the support ring 33.

The axial height of the support ring 33 is greater, as is shown in FIG. 2, than the axial height of the two-piece stroke stop ring 35, so that the bracing forces F of the valve spring 27 are transmitted to the valve body 1 via the spacer ring 31 and the support ring 33. The stroke stop ring 35 absorbs only the valve member opening forces.

The fuel injection valve for internal combustion engines according to the invention functions as follows. In the state of repose, that is, when no high-pressure pumping is taking place at the high-pressure injection pump assigned to the injection valve, the valve spring 27 keeps the valve member 8 with its sealing face 11 in contact with the valve seat face 13 on the valve body 1; the injection ports 21 are covered by the wall of the guide bore 7, so that the injection valve is closed.

In the injection event, the fuel pumped by the high-pressure injection pump, not shown in detail, passes in a known manner via the high-pressure conduit 23 and the annular gap between the guide bore 7 and the valve member 8 into the pressure chamber 17. There, the high fuel pressure engages the annular end face 15 of the valve closing head 9 in the opening direction of the valve member 8, and after a certain opening pressure is attained lifts the valve member 8 outward away from the valve seat 13, counter to the restoring force of the valve spring 27. After a brief idle stroke, the injection ports 21 emerge from their coverage by the wall of the guide bore 7, so that from the pressure chamber 17, via the inlet conduit 19 and the injection ports 21, the fuel attains injection into the combustion chamber of the engine. The maximum opening stroke motion of the valve member 8 is defined by the contact of the valve member bearing face 41 with the stationary stroke stop face 37 on the stroke stop ring 35; because these two contact faces are embodied conically, the load-bearing cross section on the valve member 8 can be increased to such an extent that breakage of the valve member 8 from hard impact with the stroke stop 37 can be reliably avoided.

The end of fuel injection is effected by terminating the delivery of high-pressure fuel, so that the pressure in the pressure chamber 17 drops back below the injection opening pressure, and the valve spring 27 puts the valve member 8 back into contact with the valve seat 13.

Figure 3:
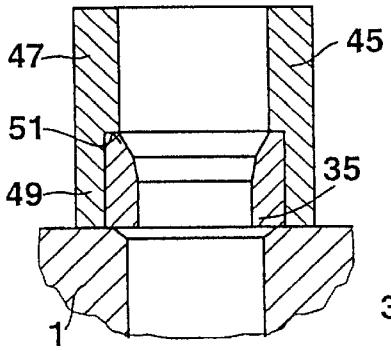
FIG. 3 shows a further exemplary embodiment in an enlarged view of a single part, in which the spacer ring and the support ring are embodied as a common sleeve which is braced directly on the valve body.
Figure 4:
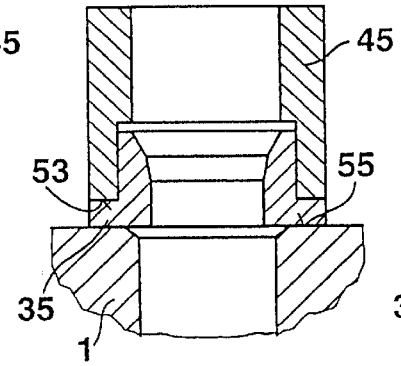
FIG. 4 shows a third exemplary embodiment in a view corresponding to FIG. 3 and in which the sleeve is braced on an annular heel of the stroke stop ring.
Figure 5:
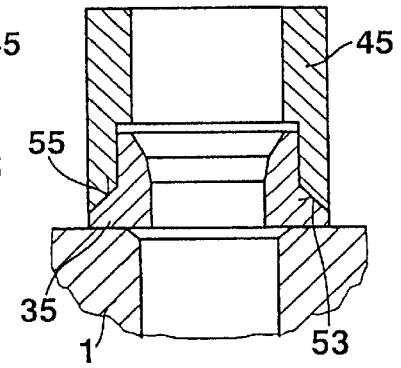
FIG. 5 shows a fourth exemplary embodiment in a view similar to that of FIGS. 3 and 4, and in which the bearing faces between the sleeve and the stroke stop ring are embodied conically.

The exemplary embodiments shown in FIGS. 3 through 5 differ from the first exemplary embodiment shown in FIGS. 1 and 2 in how the stroke stop region and the adjacent components are embodied.

FIG. 3 shows a second exemplary embodiment, in which the spacer ring 31 and the support ring 33 are embodied as a common, one-piece component. This common component has the form of a sleeve 45, which is guided with its outer circumference on the wall of the spring chamber 25 and whose internal through bore is embodied as a stepped bore. A small internal bore diameter region 47 of the sleeve 45 takes on the function of the original spacer ring 31. with an annular heel 51 formed at the internal diameter transition, the sleeve 45 rests on the plane end face region of the stroke stop ring 35, radially outside the conical stroke stop face 37. The transmission of the bracing force of the valve spring 27 is now effected into the valve body 1, via the sleeve 45 and the stroke stop ring 35; now the entire area of the annular end face of both components is available as a force-introduction face.

In the third exemplary embodiment, shown in FIG. 4, the sleeve 45 rests with its annular end face 53 toward the valve body 1 on an annular shoulder 55, formed at a cross-sectional enlargement on the outer circumference of the stroke stop ring 35. The transmission of force from the valve spring 27 now takes place via the sleeve 45 and the entire end face, toward the valve body, of the stroke stop ring 35.

In the fourth exemplary embodiment, shown in FIG. 5, the end face 53 of the sleeve 45 and the annular shoulder 55 of the stroke stop ring 35 are embodied conically, and the cone angle of the contact faces is embodied such that the axial fastening force at the sleeve 45 is oriented radially inward toward the stroke stop ring 35. In this way, at least some of the axial fastening force of the sleeve 45 can reinforce the inward-acting bracing force and can thus assure a secure pressing together of the two half shells of the stroke stop ring 35.

The one-piece embodiment of the spacer ring 31 and support ring 33 in FIGS. 3 through 5 has the advantage that the radial forces, introduced by the stroke stop ring 45 into the relatively thin-walled support ring 33, are also absorbed by the considerably more-stable spacer ring 31.

Figure 6:
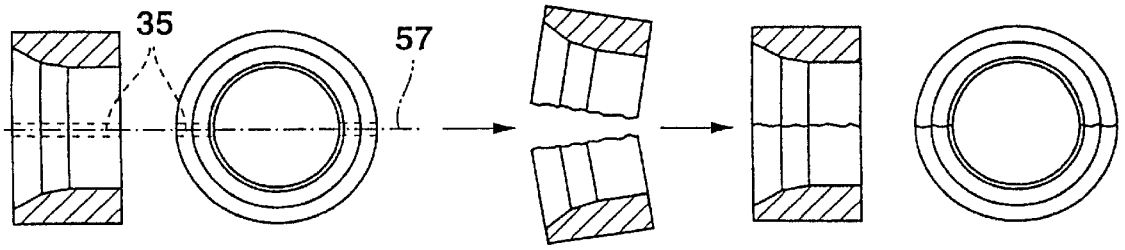
FIG. 6 illustrates the principle of the production method of the stroke stop ring of the fuel injection valve of the invention.

FIG. 6 schematically shows the production steps of the preferably two-piece stroke stop ring 35. The stroke stop ring 35 is first produced in a method that does not employ metal cutting; the stroke stop ring 35 is fabricated of a brittle material, at least in the region of the rated breaking points of the later two half shells. These rated breaking points are preferably located along a center plane 57 of the stroke stop ring 35. After the initially one-piece stroke stop ring 35 is produced, it is split into the two half shells; this splitting of the annular profile is accomplished by purposeful breakage, for example using a wedge, or by cracking. In the process, the half shells break in the brittle rated breaking region in such a way that on later being inserted into the fuel injection valve, they can be put back together again without gaps, so that a completely closed round profile is again created.

The foregoing relates to preferred exemplary embodiments of the invention, it being understood that other variants and embodiments thereof are possible within the spirit and scope of the invention, the latter being defined by the appended claims.

What is claimed is:

1. A fuel injection valve for internal combustion engines, comprising a valve member (8), which is guided axially displaceably in a bore (7) of a valve body (1) and on an end toward the combustion chamber and protruding from the bore (7) the valve member has a valve sealing face (11) with which it cooperates, to control an injection cross section, with a valve seat face (13) on the valve body (1), and having a stroke stop face (37), which is stationary relative to the valve body (1), and with which the valve member (8) comes into contact with a bearing face (41) after traversing an outward-oriented maximum opening stroke distance, and the stroke stop face (37) is disposed on an end face of an axially split stroke stop ring (35), which is surrounded by a support ring (33) and having a valve spring (27), which urges the valve member (8) in the closing direction and is supported stationary on the valve body (1) via a spacer ring (31) and an intermediate member, the support ring (33) surrounding the stroke stop ring (35) is supported stationary relative to the valve body (1) and constantly contacts the spacer ring (31).

2. The fuel injection valve according to claim 1, in which the bearing face (41) on the valve member (8) and the stroke stop face (37) are embodied conically on the stroke stop ring (35).

3. The fuel injection valve according to claim 1, in which the stroke stop ring (35) is embodied in two half shells, and the two half shells form a closed stop ring in the fuel injection valve that rests with an annular end face remote from the stroke stop face (37) on the valve body (1).

4. The fuel injection valve according to claim 1, in which the support ring (3), fastened between the valve body (1) and the spacer ring (31), has a greater axial height than the stroke stop ring (35).

5. The fuel injection valve according to claim 1, in which the spacer ring (31) and the stroke stop ring (33) are embodied as a common, one-piece component.

6. The fuel injection valve according to claim 5, in which the spacer ring (31) and the support ring (3) are embodied as a common sleeve (45), which is guided with an outer circumference in a housing of a valve-holding body (5) braced axially with the valve body (1).

7. The fuel injection valve according to claim 6, in which the internal diameter of the sleeve (45) is embodied as a stepped bore, and a sleeve part (45) having a smaller internal bore diameter takes on the function of the spacer ring (31), and a sleeve part (49) having a larger internal bore diameter takes on the function of the support ring (33) surrounding the stroke stop ring (35).

8. The fuel injection valve according to claim 6, in which the sleeve (45) rests axially on the stroke stop ring (35).

9. The fuel injection valve according to claim 7, in which the sleeve (45) rests, with an annular heel (51) at the internal diameter transition, on a plane end face region (39) radially outside the conical stroke stop face (37) of the stroke stop ring (35).

10. The fuel injection valve according to claim 8, in which the sleeve (45) rests, with an annular heel (51) at the internal diameter transition, on a plane end face region (39) radially outside the conical stroke stop face (37) of the stroke stop ring (35).

11. The fuel injection valve according to claim 8, in which the sleeve (45) rests, with its end face (53) toward the valve body (1), on an annular shoulder (55) formed at a cross-sectional widening at an outer circumference of the stroke stop ring (35).

12. The fuel injection valve according to claim 11, in which the end face (53) of the sleeve (45) toward the valve body (1) and the annular shoulder (55) cooperating with the end face are embodied conically on the stroke stop ring (35) and the cone angle is embodied such that a portion of the axial fastening force at the sleeve is oriented radially inward in the direction of the stroke stop ring (35).

13. The fuel injection valve according to claim 1, in which the stroke stop ring (35) is embodied in two half shells, and the two half shells are formed by breaking the closed stroke stop ring (35).

14. The fuel injection valve according to claim 13, in which breakage lines extend along a center plane (57) of the stroke stop ring (35).

15. The fuel injection valve according to claim 13, in which the stroke stop ring (35) is made, at least in the region of rated breaking points, from a brittle material.

16. The fuel injection valve according to claim 13, in which the stroke stop ring (35) is made by a non-metal cutting process.

* * * * *